US011069948B2

(12) United States Patent
Caratelli et al.

(10) Patent No.: US 11,069,948 B2
(45) Date of Patent: Jul. 20, 2021

(54) SURFACE INTEGRATED WAVEGUIDE INCLUDING TOP AND BOTTOM CONDUCTIVE LAYERS HAVING AT LEAST ONE SLOT WITH A SPECIFIC CONTOUR

(71) Applicant: The Antenna Company International N.V., Curacao (CW)

(72) Inventors: Diego Caratelli, Duizel (NL); Pietro Bia, Matera (IT); Luciano Mescia, Trigianno (IT)

(73) Assignee: The Antenna Company International N.V., Curacao (CW)

( * ) Notice: Subject to any disclaimer, the term of this patent is extended or adjusted under 35 U.S.C. 154(b) by 28 days.

(21) Appl. No.: 16/463,571

(22) PCT Filed: Nov. 22, 2017

(86) PCT No.: PCT/NL2017/050762
§ 371 (c)(1),
(2) Date: May 23, 2019

(87) PCT Pub. No.: WO2018/097713
PCT Pub. Date: May 31, 2018

(65) Prior Publication Data

US 2019/0319326 A1 Oct. 17, 2019

(30) Foreign Application Priority Data

Nov. 24, 2016 (NL) ..... 2017865

(51) Int. Cl.
*H01P 3/12* (2006.01)
*H01Q 9/04* (2006.01)
(Continued)

(52) U.S. Cl.
CPC ..... *H01P 3/121* (2013.01); *H01Q 9/0485* (2013.01); *H01Q 13/22* (2013.01); *H01Q 21/005* (2013.01)

(58) Field of Classification Search
CPC ..... H01P 3/121; H01Q 13/22; H01Q 13/24; H01Q 21/005
(Continued)

(56) References Cited

U.S. PATENT DOCUMENTS 6,359,590 B2 * 3/2002 Takenoshita ..... H01P 3/121 343/700 MS
7,620,527 B1 * 11/2009 Gielis ..... G06F 30/00 703/2
(Continued)

FOREIGN PATENT DOCUMENTS

EP 2 267 841 A1 12/2010
WO 2015/147635 A1 10/2015

OTHER PUBLICATIONS

Paraforou et al., "A Novel Supershaped Slot-Loaded Printed Dipole Antenna with Broadside Radiation for Dual-Band WLAN Applications", The 8th European Conference on Antennas and Propagation (EuCAP 2014), European Association on Antennas and Propagation, p. 2859-2862; 4 pages.
(Continued)

*Primary Examiner* — Benny T Lee
(74) *Attorney, Agent, or Firm* — Maier & Maier, PLLC

(57) ABSTRACT

A waveguide for electromagnetic radiation, which is a substrate integrated waveguide which is basically a laminate of planar layers includes a substrate layer of dielectric material; a bottom layer and a top layer of an electrically conductive material provided on the respective bottom surface and top surface of the substrate layer; a multitude of pillars of electrically conductive material which extend through the substrate layer from its bottom to its top surface
(Continued)

and which are electrically connected to the bottom and top layer; wherein at least one of the bottom and top layer contains at least one part that is void of electrically conductive material, which part is referred to as a slot.

16 Claims, 8 Drawing Sheets

(51) Int. Cl.
*H01Q 13/22* (2006.01)
*H01Q 21/00* (2006.01)

(58) Field of Classification Search
USPC ..... 333/239, 237
See application file for complete search history.

(56) References Cited

U.S. PATENT DOCUMENTS

2009/0066597 A1 3/2009 Yang et al.
2010/0321265 A1* 12/2010 Yamaguchi et al. ..... H01Q 21/0043 343/771
2018/0226709 A1* 8/2018 Mangaiahgari ..... G01S 13/0209

OTHER PUBLICATIONS

International Search Report and Written Opinion of the International Searching Authority dated Mar. 16, 2018 in corresponding International application No. PCT/NL2017/050762; 14 pages.

* cited by examiner

SURFACE INTEGRATED WAVEGUIDE INCLUDING TOP AND BOTTOM CONDUCTIVE LAYERS HAVING AT LEAST ONE SLOT WITH A SPECIFIC CONTOUR

FIELD

The present application relates to a waveguide for electromagnetic radiation, which is a substrate integrated waveguide which is basically a laminate of planar layers comprising:

- a substrate layer of dielectric material;
- a bottom layer and a top layer of an electrically conductive material provided on the respective bottom surface and top surface of the substrate layer;
- a multitude of pillars of electrically conductive material which extend through the substrate layer from its bottom surface to its top surface and which are electrically connected to the bottom layer and top layer;
- wherein at least one of the bottom and top layer contains at least one area that is void of electrically conductive material, which area is referred to as a slot.

Such a waveguide enables an electromagnetic wave to propagate with reduced loss of energy by restricting the electromagnetic field expansion to substantially one dimension. As such, the waveguide is expediently integrated with an antenna structure for receiving and/or transmitting electromagnetic radiation.

It should be noted that the waveguide affects the propagation of electromagnetic waves in such a way that the relevant wavelength is changed to a different value as compared to the wavelength in free space. This altered wavelength that is achieved in a waveguide structure is referred to as the 'guided wavelength' or $\lambda_g$.

Furthermore, it has been observed that a slot provided in one of the conductive layers of the waveguide, is effective in improving the gain and efficiency of an antenna unit that is provided with such a waveguide. The shape of the slot that is used has the contour of a rectangular body. The slot can be seen as a removed part of the conductive layer, and is also produced in such a way, i.e., by removal of a part of the layer by excision.

BACKGROUND

However, when such a waveguide is used in a frequency range of 58 to 62 GHz, it has been observed that, in order to have a viable waveguide, a further improvement is needed in terms of an improved gain within this frequency range, which is preferably achieved over this whole frequency range.

This need is based on the observation that in this relatively high frequency range, there is a relatively high loss of signal in comparison to a frequency range from 2.5 to 6.0 GHz that is commonly used for Wi-Fi applications.

SUMMARY OF THE INVENTION

It is therefore an objective of the invention to improve the presently known waveguide of the above indicated type, so that the waveguide further improves gain values when used in combination with an antenna unit. Furthermore, another objective is that the gain values are improved over a broad range of the frequencies for which the waveguide is suitable.

In order to achieve this objective, the invention provides for:

A waveguide for electromagnetic radiation, which is a substrate integrated waveguide which is basically a laminate of planar layers comprising:

- a substrate layer of dielectric material;
- a bottom layer and a top layer of an electrically conductive material provided on the respective bottom surface and top surface of the substrate layer;
- a multitude of pillars of electrically conductive material which extend through the substrate layer from its bottom surface to its top surface and which are electrically connected to the bottom layer and top layer;

wherein at least one of the bottom and top layer contains at least one part that is void of electrically conductive material, which part is referred to as a slot;

characterized in that the at least one slot is delimited, in the plane of the respective layer in which the slot is present, by a contour which is defined by an x coordinate and y coordinate which fulfils the following equations:

$$x(\phi)=c_x R(\phi)\cos(\phi)$$

$$y(\phi)=c_y R(\phi)\sin(\phi)$$

wherein:

$$R(\phi)=\left[\left|\frac{\cos\left(\frac{m_1\phi}{4}\right)}{a_1}\right|^{n_1}+\left|\frac{\sin\left(\frac{m_2\phi}{4}\right)}{a_2}\right|^{n_2}\right]^{\frac{1}{b_1}}$$

wherein the values for the parameters $c_x$, $c_y$, $m_1$, $m_2$, $a_1$, $a_2$, $n_1$, $n_2$ and $b_1$ are selected from the group of real numbers of positive value, and $\phi$ is an angular coordinate that covers the range from $-\pi$ to $\pi$;

with the provision that the contour is not of a rectangular shape, not of a rounded rectangular shape, and not of a cross-shape.

Surprisingly, it has been found that the contour of the slot significantly influences the gain values obtained when using the waveguide for electromagnetic radiation.

In particular, it was found, that using a contour that is different from a rectangular shape, it was possible to improve the obtained gain value significantly, and also over a relatively broad applicable range of frequencies.

The equations that define the x coordinate and y coordinate of the contour of the invention, are based on the so-called Gielis formula, which is described in more detail in various publications by the inventor Johan Gielis, which includes U.S. Pat. No. 7,620,527. Reference is made to this patent for further background information, especially on the variety of shapes that can be synthesized based on an appropriate choice of values for all included parameters.

The waveguide according to the invention may be provided with only one slot, which is referred to as a single slot waveguide, and is the primary embodiment of the invention.

Alternative structures which included multiple slots per waveguide are explained in more detail below as secondary and tertiary embodiments of the invention.

Preferably, in the waveguide according to the invention, the substrate layer, the bottom layer and the top layer each have a rectangular circumference in the plane of the respective layer.

It is advantageous in the waveguide according to the invention, that the substrate layer, the bottom layer and the top layer each have a rectangular circumference of similar dimensions.

The format of the waveguide being rectangular is effective for the functioning of the waveguide, and is advantageous in respect to the techniques used in producing the waveguide.

Some optional features or properties of the waveguide according to the invention, and which are commonly applied in a substrate integrated waveguide, are the following:

- The waveguide has a central longitudinal axis (la), thus defining a length and defining a width transverse to the axis, which both extend parallel to the plane of the substrate layer.
- The length (i.e. the size in the longitudinal direction) of a single slot waveguide is about ¾ of the guided wavelength $\lambda_g$ of the frequency range for which the waveguide is used. This value may optionally be raised by k $\lambda_g/2$, in which k is an integer of non-negative value.
- The pillars are provided in a row of separate pillars that are disposed proximal to the circumferential sides of the substrate layer.
- One circumferential side of substrate layer is not provided with a row of pillars, which side functions as an entry side or port side for electromagnetic radiation. The entry side is crossed by the central longitudinal axis.
- Taking into account the specific frequency range in which the waveguide is used, the appropriate dimensioning of the row of pillars is determined by calculation, which includes the diameter of the pillars and the distance between adjacent pillars.

Specific properties that apply to the dimensioning of the slot according to the invention are the following:

- The slot has a central point which is determined by the mean value of the slot width and the mean value of the slot length.
- The central point of the slot is located, preferably, half the guided wavelength from the entry side in the longitudinal direction. This value may optionally be raised by k $\lambda_g/2$.
- The central point of the slot is located about ¼ of the guided wavelength from the most proximal pillars, seen in the longitudinal direction. This value may optionally be raised by $k\lambda_g/2$.
- The central point of the slot is present in transverse direction at a pre-selected offset distance from the longitudinal axis projected on the respective layer.

In particular, it is preferred that the waveguide according to the invention is designed to be effective for electromagnetic radiation in the frequency range from 58 to 62 GHz.

Apart from a waveguide that is suitable for radiation in the frequency range from 58 to 62 GHz, the invention further encompasses also a waveguide that is suitable for upcoming radio-frequency applications in IEEE K and Ka bands (e.g., 24 GHz, 28 GHz, 40 GHz), as well as for remote sensing and future wireless services in W band (e.g., 70 GHz, 80 GHz, 90 GHz) and at larger frequencies in the millimeter-wave range.

This frequency range of 58 to 62 GHz has gained special commercial interest as this frequency range is an important allocated ISM frequency band referred to as '60 GHz band', which is developed in view of 5G mobile networks, terabit wireless networks etc. The range contains four channels of which the frequency range from 59.40 to 61.56 is most interesting as this frequency range overlaps with all regionally allocated frequency ranges that are included in this band.

Some optional features or properties of the waveguide according to the invention, which contribute to being effective in the frequency range from 58 to 62 GHz, are:

- The dielectric material of the substrate layer has a relative permittivity εr of 2.2, or in the range from 1.8 to 2.6. For instance, is a commercially available material 'RT/DUROID® 5880' applied.
- The thickness of the substrate layer is preferably 0.508 mm, or in the range from 0.40 mm to 0.70 mm.
- The diameter of the pillars is 0.4 mm, or in the range of 0.35 to 0.45 mm; the distance between the centers of adjacent pillars is preferably 0.6 mm, or in the range of 0.55 to 0.65 mm.
- Given the dimensioning of the rows of pillars and the chosen permittivity, the optimum width (i.e. measured transverse to the central longitudinal axis of the waveguide) between the centers of pillars at opposite sides, corresponds to about 2.8 mm, which value may vary by 0.2 mm. Consequently, the resulting overall width of the waveguide is about 3.6 mm.

The guided wavelength $\lambda_g$. in the frequency range of 58-62 GHz, has a mean value for this range of approximately 4.64 mm, which results in the following preferred dimensions of the waveguide:

- The length of a single slot waveguide is about ¾ of the guided wavelength, i.e. about 3.50 mm. This value may be raised by $k\lambda_g/2$.
- The longitudinal distance from the mean value of slot length to the proximal pillars is about ¼ of the guided wavelength, i.e. 1.16 mm. This value may be raised by $k\lambda_g/2$.

It is further preferred in the waveguide according to the invention, that the central point of the slot is positioned at an offset distance (Δ) from the longitudinal axis projected on the respective layer which lies in the range of 0.20 to 0.30 mm, and preferably is 0.25 mm.

It is especially preferred in the waveguide according to the invention, that the slot length lies in the range of 1.8 to 2.7 mm, and preferably is 1.9, 2.2, 2.5 or 2.7 mm.

Further preferably, in the waveguide according to the invention, the slot width lies in the range of 0.24 to 0.32 mm, and preferably is 0.28 mm.

It is preferred in the waveguide according to the invention, that the two-dimensional contour of the slot has a shape similar to the two-dimensional projections of either a hat or a bow-tie, which similar shapes are oriented in the longitudinal direction of the waveguide.

For clarity, the similar shapes of the two-dimensional projections of either a hat or a bow-tie are further defined as follows:

The bow-tie shape is based on a circumference of two lobes connected at a narrowed central section wherein the shape is oriented in the longitudinal direction of the waveguide;

The hat shape is based on a circumference comprising a line that runs straight and parallel to the longitudinal direction of the waveguide, and an opposed line of which the middle part is at a further distance from the straight side than the complementing parts adjacent to the middle part, so that the slot has an enlarged width over the middle part of its slot length in comparison to complementing parts adjacent to the middle part.

Other types of shapes for the two-dimensional contour of the slot are also encompassed by the invention, such as a two-dimensional butterfly shape which is shown as an example in one of the appended figures.

More specifically, it is preferred in the waveguide according to the invention, that the contour is defined by the following parameters:

$c_x$ is chosen from the range $6.0\times10^{-5}$ to $8.0\times10^{-5}$, $c_y$ is chosen from the range $7.4\times10^{-4}$ to $9.6\times10^{-4}$, $m_1=2.8$, $m_2=3.2$, $a_1=a_2=1$, $n_1=n_2=5$ and $b_1=2$.

Such a contour based on the above selection of parameters, includes a contour that has a shape similar to the projection of a hat.

Furthermore specifically, it is preferred in the waveguide according to the invention, that the contour is defined by the following parameters:

$c_x$ is chosen from the range $4.0\times10^{-6}$ to $9.0\times10^{-5}$, $c_y$ is chosen from the range $1.25\times10^{-6}$ to $3.8\times10^{-5}$, $m_1=4$, $m_2=0.5$, $a_1=a_2=1$, $n_1=5$, $n_2=8$, and $b_1$ is chosen from the range of 2 up to 4.

Such a contour based on the above selection of parameters, includes a contour that has a shape similar to the projection of a bow-tie.

In a preferred secondary embodiment of the waveguide according to the invention, at least one of the bottom and top layers contains at least one linear array of slots, which slots are disposed on a line extending in the longitudinal direction of the waveguide, wherein the slots are spaced apart from each other by a distance in the longitudinal direction.

For the sake of completeness, it is noted that each slot of the linear array may comprise one or more of the features already described above with respect to a single slot, such as in a single slot waveguide which is the primary embodiment of the invention.

Importantly, as the secondary embodiment of the invention includes multiple slots on a linear array, higher absolute values for the peak gain can be achieved in comparison to a single slot configuration.

In the above secondary embodiment of the invention, it is preferred that the central points of the slots are positioned at a pre-determined offset distance from the longitudinal axis projected on the respective layer, and that the central points of adjacent slots are positioned on different sides of the central longitudinal axis projected on the respective layer.

Such a formation has been found effective in achieving the general objective of the invention.

Furthermore, it is preferred that in the secondary embodiment of the invention, the distance between the central points of adjacent slots in the longitudinal direction is preferably half of the guided wavelength that is applied. This value may optionally be raised by $k\ \lambda_g/2$.

Additionally, it is preferred that in the secondary embodiment of the invention, the number of slots contained in the linear array is 6 to 10, and preferably 8.

Furthermore, it is preferred that the waveguide according to the secondary embodiment of the invention, has a length that corresponds to the guided wavelength that is applied multiplied by a factor of 3 to 5, preferably 4. This value may optionally be raised by $k\ \lambda_g/2$.

In a preferred tertiary embodiment of the waveguide according to the invention, at least one of the bottom layer and top layer contains a number of linear arrays of slots, wherein the linear arrays of arrays are disposed adjacent to each other and in parallel direction, so that a grid of slots is formed, wherein the slots per linear array are disposed on a line extending parallel to the longitudinal direction of the waveguide, wherein the slots per linear array are spaced apart from each other by a distance in the longitudinal direction, wherein between adjacent linear arrays a row of separate pillars is provided, and a row of separate pillars is disposed proximal to the circumferential sides of the substrate layer, wherein one circumferential side of the substrate layer is not provided with a row of pillars.

Based on the structure of the tertiary embodiment, the absolute value for the peak gain that can be achieved is further raised in comparison to the secondary embodiment.

For sake of completeness, it is noted that in the tertiary embodiment of the invention, each linear array of slots may comprise one or more of the features already described above with respect to a single linear array of slots, i.e. the secondary embodiment of the invention.

In regard of the tertiary embodiment of the invention, it is preferred that the number of linear arrays is 3 to 5, preferably 4.

In a further embodiment of the invention, it is preferred that the waveguide of the invention is integrated with a receiving and/or transmitting unit for electromagnetic radiation, which is preferably operable in the frequency range from 58 to 62 GHz.

BRIEF DESCRIPTION OF THE DRAWINGS

The invention will be further elucidated herein below with reference to the attached drawings of which.

DETAILED DESCRIPTION OF THE INVENTION

Figure 1:
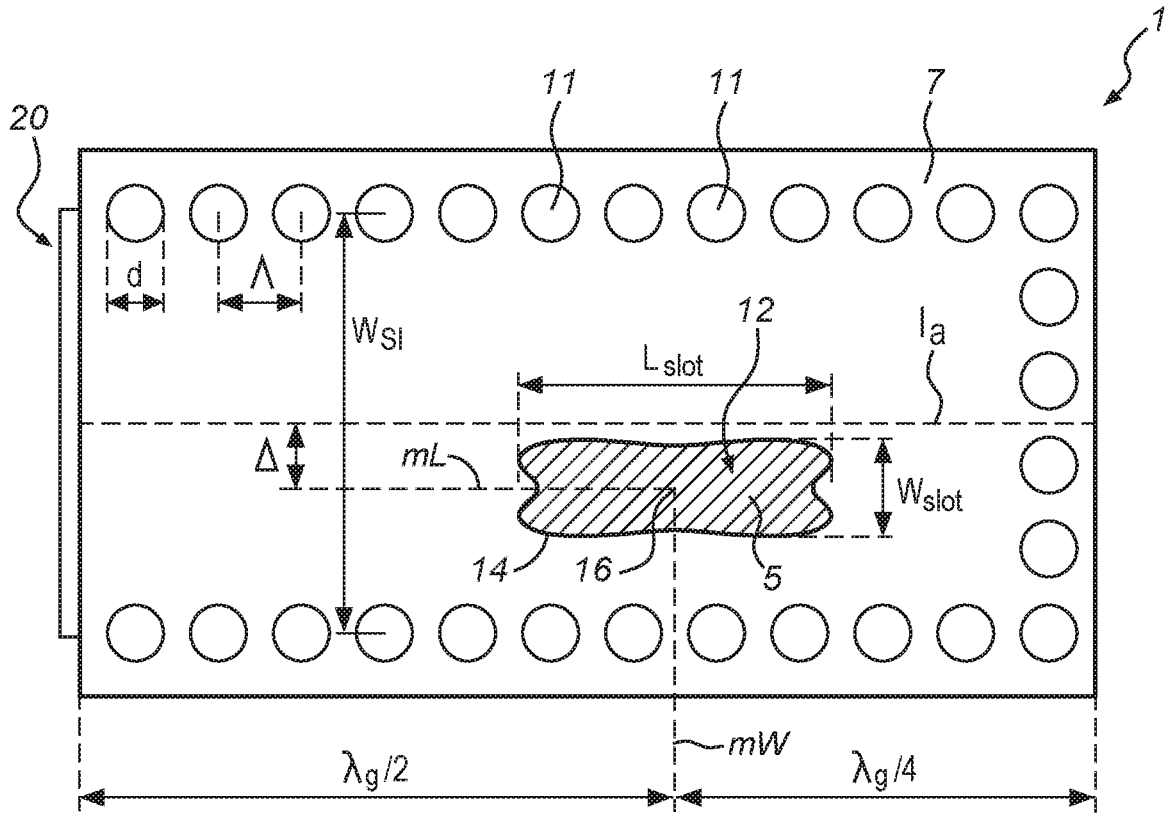
FIG. 1 shows a top view of a single slot waveguide according to a preferred primary embodiment of the invention.

FIG. 1 shows a top view of a single slot waveguide 1 having a longitudinal axis $\mathbf{1}_a$, which is provided with a top layer 7 of a rectangular form. The top layer is provided on a non-visible substrate layer 5 which has the same form and size as the top layer 7. The opposed bottom surface of the substrate layer 5 is covered with a bottom layer 9 (FIG. 1A).

Figure 1A:
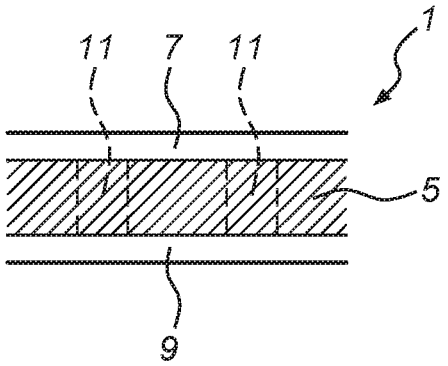
FIG. 1*a* shows a longitudinal cross-section of the waveguide of FIG. 1.

The circles indicate a row of non-visible pillars 11 that are connected to the bottom side of the top layer 7 and extend through the underlying substrate layer 5 as further indicated in FIG. 1*a* and are connected to the bottom layer 9. The pillars 11 have a diameter d, and a regular distance A between the centers of consecutive pillars in a row. The pillars are provided in a row of separate pillars that are disposed proximal to the circumferential sides of the substrate layer 5. At one circumferential side 20, the substrate layer 5 is not provided with a row of pillars 11. This side 20 functions as an entry side or port side for electromagnetic radiation.

The pillars 11, the bottom layer 9 and the top layer 7 are made from copper. The substrate layer 5 is made from a dielectric material.

When electromagnetic radiation of 60 GHz is applied to the single slot waveguide according to FIG. 1, the guided wavelength $\lambda_g$ is approximately 4.64 mm.

The length of the waveguide is about ¾ of the guided wavelength $\lambda_g$ for which the waveguide is suited, for instance about 3.50 mm.

The overall width of the waveguide is related to the optimum width $W_{SI}$ between directly opposed pillars at two longitudinal sides of the waveguide. The width $W_{SI}$ corresponds to about 2.8 mm, which value may vary by 0.2 mm. The resulting overall width of the waveguide is about 3.6 mm.

The diameter of the pillars is about 0.4 mm and the distance A between the pillars is about 0.6 mm.

The top layer 7 is provided with a slot 12 having a contour 14 of a butterfly shape. The slot is a removed part of the layer 7, thus revealing a part of the underlying substrate layer 5. The butterfly shape is a contour that fulfils the equations for the x coordinate and y coordinate according to the present invention.

The contour 14 of the slot 12 has a maximum width $W_{slot}$ and a maximum length Loot.

The slot 12 has a central point 16 which lies at the crossing of the mean value of the slot width indicated by the line mW and the mean value of the slot length indicated by the line mL.

The central point of the slot 16 is located half a guided wavelength $\lambda_g/2$ from the entry side 20, measured in the longitudinal direction.

The central point of the slot 16 is located about ¼ of the guided wavelength $\lambda_g/4$ from the most proximal pillars, measured in the longitudinal direction.

The central point of the slot 16 is present in transverse direction at a pre-selected offset distance A from the longitudinal axis $\mathbf{1}_a$ projected on the respective layer 7. FIG. 1A shows a longitudinal cross-section of the waveguide 1 of FIG. 1, along the longitudinal axis $\mathbf{1}_a$. Onto the substrate layer 5 are provided a top layer 7 and a bottom layer 9, which are made from copper. The substrate layer 5 has a relative permittivity εr of 2.2, and is made of RT/DUROID® 5880 material. The thickness of the substrate layer is 0.50 mm. The exact thickness of the copper layers is less critical, and are merely shown schematically. The non-visible pillars 11 located at circumferential sides of the substrate layer 5, are indicated by dotted lines and establish the connection between the top and bottom layers 7 and 9.

Figure 2:
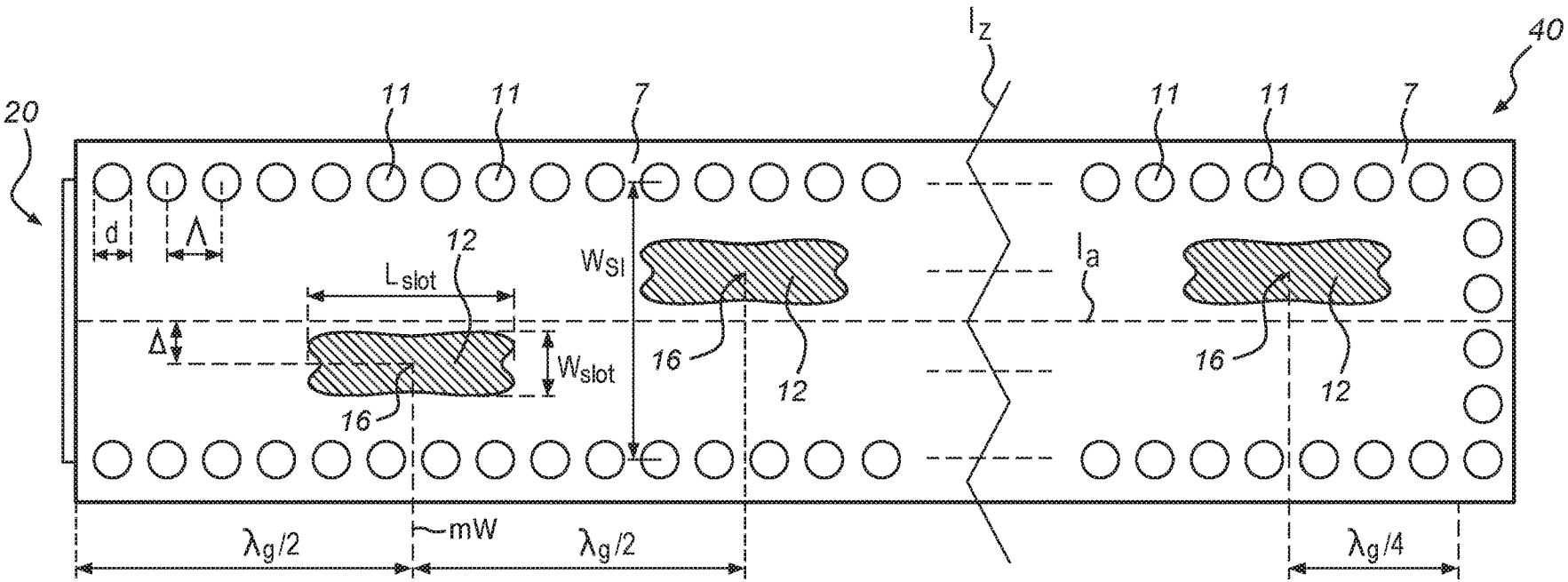
FIG. 2 shows a top view of a waveguide according to a preferred secondary embodiment of the invention.

FIG. 2 shows a top view of a waveguide 40 having a longitudinal axis $\mathbf{1}_a$, which is provided with a top layer 7 of a rectangular form. The top layer is provided on a non-visible substrate layer 5 (FIG. 1) which has the same form and size as the top layer 7. The opposed bottom surface of the substrate layer is covered with a bottom layer 9 (FIG. 1A).

Analogously to FIG. 1, the circles indicate a row of non-visible pillars 11 that are connected to the bottom side of the top layer and extend through the underlying substrate layer and are connected on the other side of the substrate layer to a bottom layer.

The top layer 7 is provided with a linear array of slots 12, each slot having a contour of a butterfly shape. The slots 12 in the array are disposed on a line extending in the longitudinal direction of the waveguide, wherein the slots are spaced apart from each other by a regular distance in the longitudinal direction, which distance is about half the value of the guided wavelength (i.e., $\lambda_g/2$). The distance is measured between the central points 16 of adjacent slots. The zig-zag line $l_z$, indicates an interruption of the depicted linear array, which actually contains eight slots, and not just three as indicated in FIG. 2. An image of such a full configuration with eight slots is shown in another attached figure.

With regard to the positioning of the slots 12, it is remarked that the central points of the slots are positioned at a pre-determined offset distance A, and that the central points of adjacent slots are positioned on different sides of the central longitudinal axis $\mathbf{1}_a$ projected on the respective layer.

Further indicated values and reference numbers have an equal meaning as the ones given in respect of FIG. 1 for the single slot waveguide, with the exception of the offset value which is 0.10 mm, instead of 0.25 mm in FIG. 1.

Figure 3:
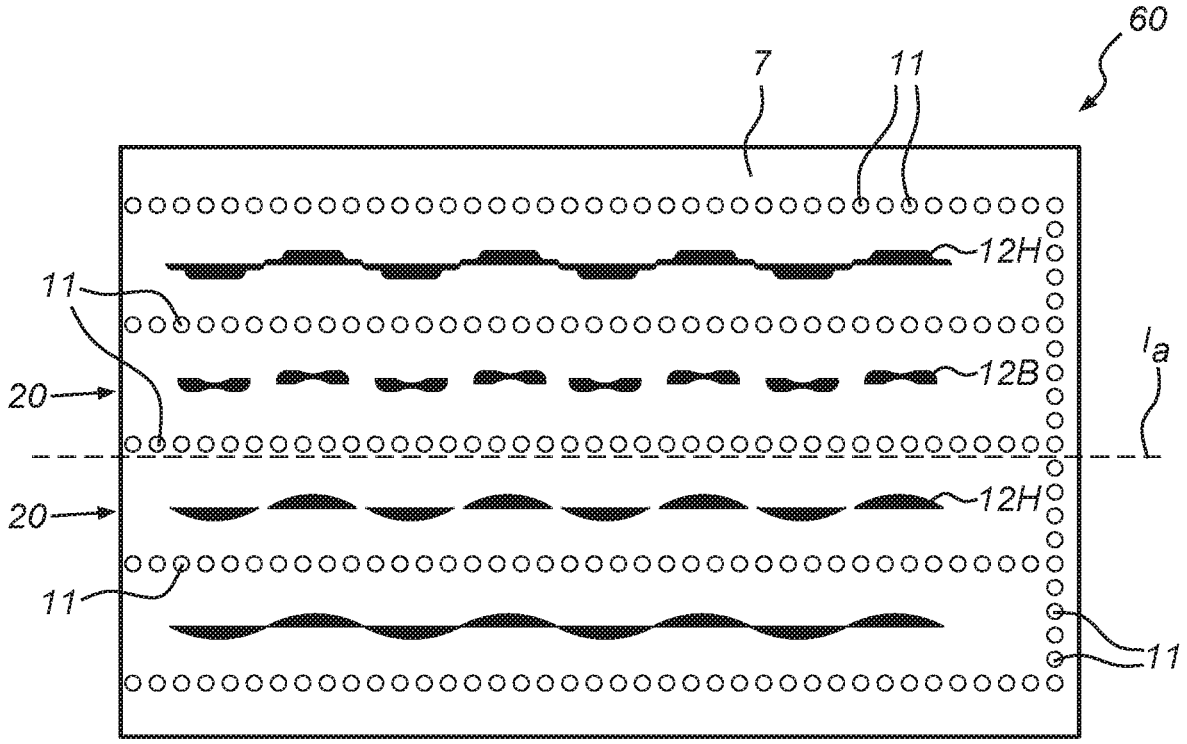
FIG. 3 shows a top view of a waveguide according to a preferred tertiary embodiment of the invention.

FIG. 3 shows a top view of a waveguide 60 having a longitudinal axis $\mathbf{1}_a$, which is provided with a top layer 7 of a rectangular form. The top layer is provided on a non-visible substrate layer 5 (FIG. 1) which has the same form and size as the top layer 7. The opposed bottom surface of the substrate layer is covered with a bottom layer 9 (FIG. 1).

Analogously to FIG. 2, the circles indicate rows of non-visible pillars 11 that are connected to the bottom side of the top layer and extend through the underlying substrate layer and are connected on the other side of the substrate layer to a bottom layer.

The top layer is provided with four linear arrays of slots 12H, 12B, which are disposed adjacent to each other and in parallel direction to the longitudinal axis $\mathbf{1}_a$, so that a grid of slots is formed. In each linear array, the slots 12H, 12B, are spaced apart from each other in the same manner as indicated in FIG. 2, by a half of the guided wavelength. Analogously, the offset distance alternates per adjacent slot in a linear array of slots. One linear array has slots that have a contour of a so-called "bow-tie shape" 12B, the other linear arrays have slots with a contour of a so-called "hat shape" 12H. Both these shapes will be further explained below.

Between adjacent linear arrays a row of separate pillars 11 is provided. Furthermore, a row of separate pillars is disposed proximal to the circumferential sides of the substrate layer. Each linear array has a respective entry side 20 which is devoid of pillars 11.

Figure 4A:
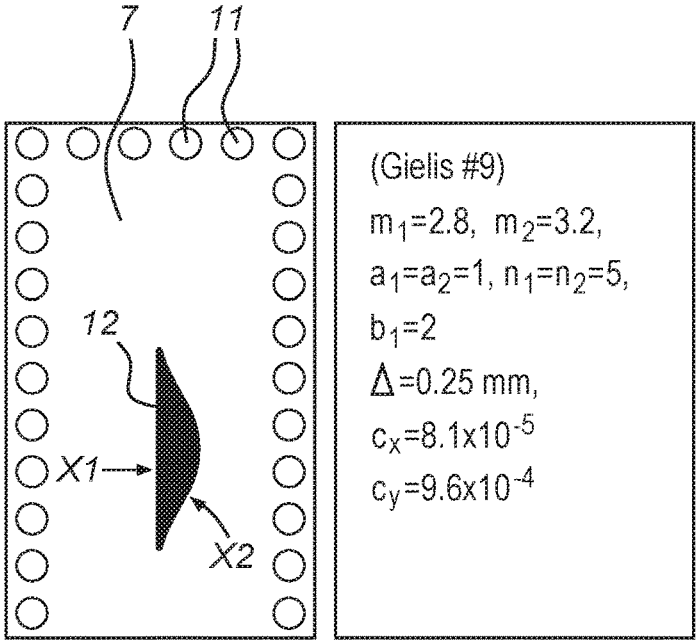
FIG. 4*a* shows a first group of single slot waveguides with a preferred contour of the slot.

FIGS. 4*a*), 4*b*) and 4*c*) respectively show a top view of a first group of single slot waveguides with a preferred contour of the slot of which the x coordinate and y coordinate of the above equations are based on the indicated choice of parameters and applied in the equations according to the invention.

In FIG. 4*a*, (Gielis #9), $m_1=2.8$, $m_2=3.2$, $a_1=a_2=1$, $n_1=n_2=5$, $b_1=2$, $\Delta=0.25$ mm, $c_x=8.1\times10^{-5}$, and $c_y=9.6\times10^{-4}$.

Figure 4B:
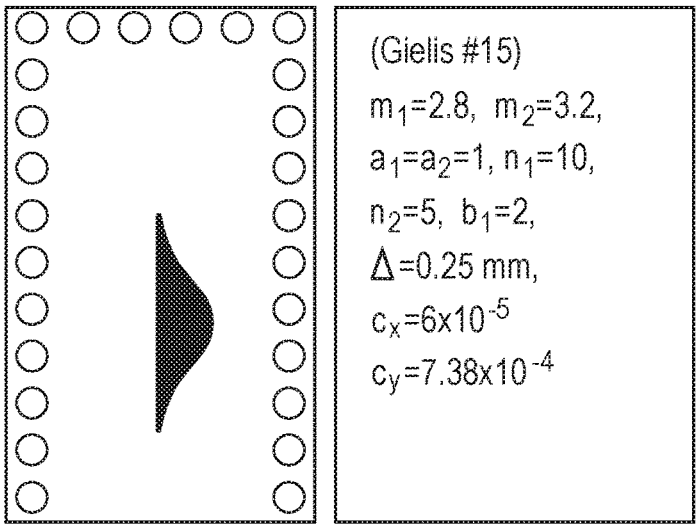
FIG. 4*b* shows a first group of single slot waveguides with a preferred contour of the slot.
Figure 4C:
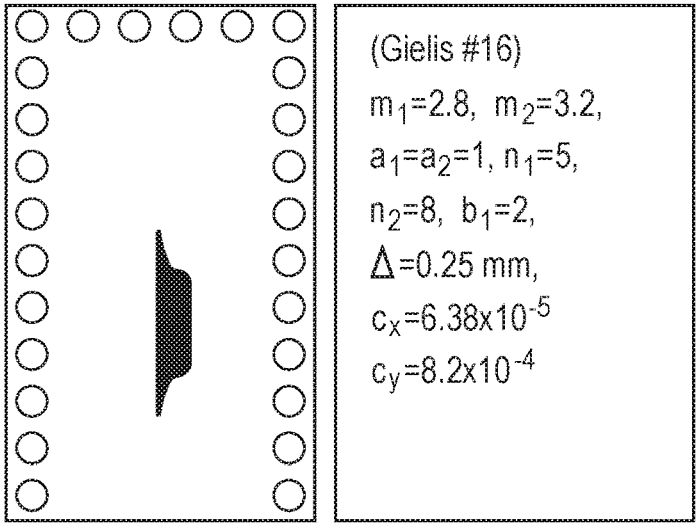
FIG. 4*c* shows a first group of single slot waveguides with a preferred contour of the slot.

In FIG. 4*b*, (Gielis #15), $m_1$=2.8, $m_2$=3.2, $a_1$=$a_2$=1, $n_1$=10, $n_2$=5, $b_1$=2, Δ=0.25 mm, $c_x$=6×10$^{-5}$, and $c_y$=7.38×10$^{-4}$. In FIG. 4*c*, (Gielis #16), $m_1$=2.8, $m_2$=3.2, $a_1$=1, $n_1$=5, $n_2$=8, $b_1$=2, Δ=0.25 mm, $c_x$=6.38×10$^{-5}$, and $c_y$=8.2×10$^{-4}$.

The three waveguides include the same basic properties already shown in FIG. 1, only the contour of the slot is different. The slots of these waveguides have a general contour in common, that is hereby indicated as a 'hat shape'. Further, the shown waveguides are single slot waveguides that include a top layer 7, pillars 11, and a slot 12.

The hat shape in FIGS. 4*a*) to 4*c*) is based on a circumference comprising a line X1 (FIG. 4*a*) that runs straight and parallel to the longitudinal direction of the waveguide, and an opposed line X2 (FIG. 4*a*) of which the middle part is at a further distance from the straight side than the complementing parts adjacent to the middle part, so that the slot has an enlarged width over the middle part of its slot length in comparison to complementing parts adjacent to the middle part.

Figure 5A:
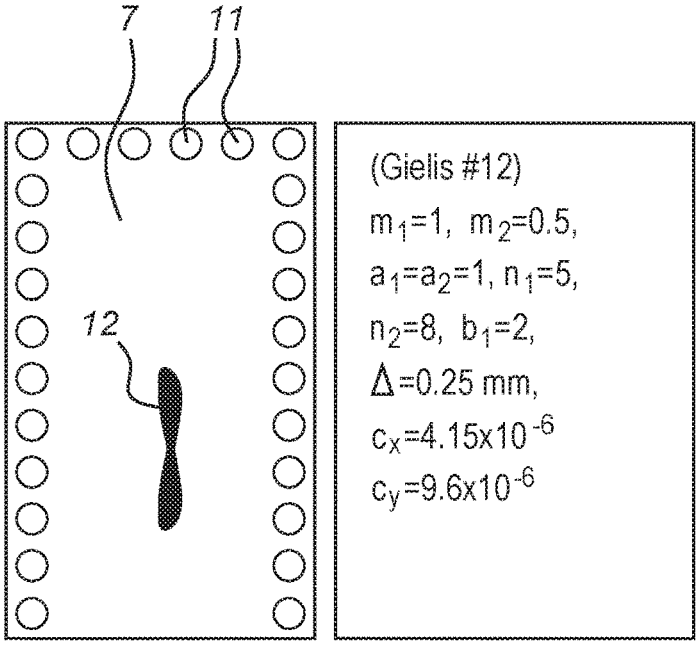
FIG. 5*a* shows a second group of single slot waveguides with a preferred contour of the slot.
Figure 5B:
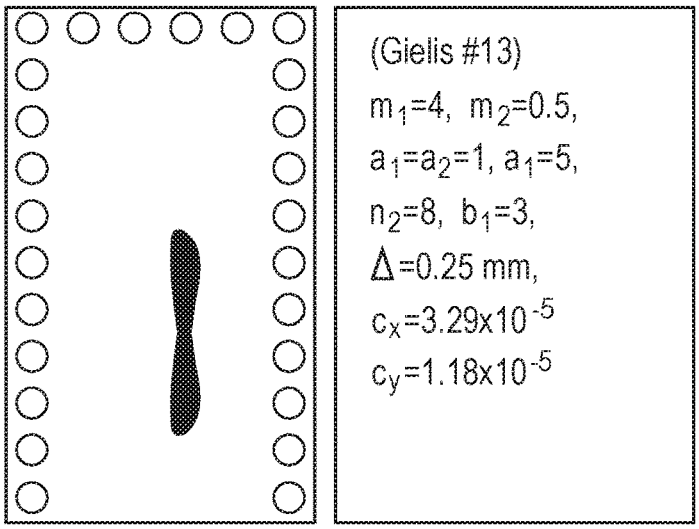
FIG. 5*b* shows a second group of single slot waveguides with a preferred contour of the slot.
Figure 5C:
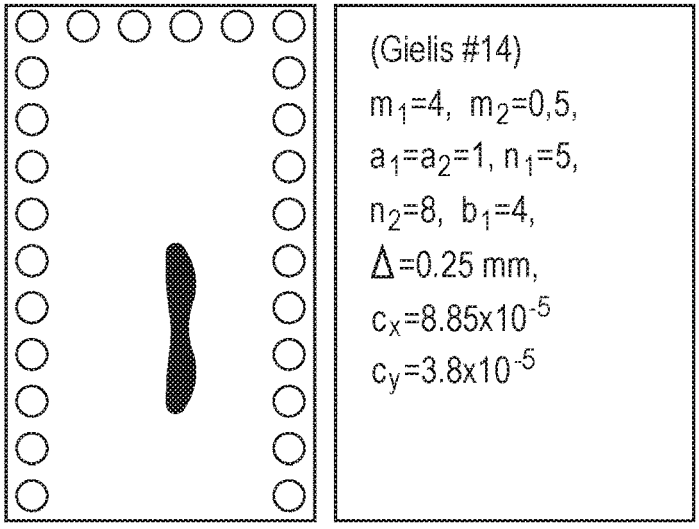
FIG. 5*c* shows a second group of single slot waveguides with a preferred contour of the slot.

FIGS. 5*a*), 5*b*) and 5*c*) respectively show shows a second group of single slot waveguides with a preferred contour of the slot of which the x coordinate and y coordinate of the above equations are based on the indicated choice of parameters and applied in the equations according to the invention. In FIG. 5*a*, (Gielis #12), $m_1$=1, $m_2$=0.5, $a_1$=$a_2$=1, $n_1$=5, $n_2$=8, $b_1$=2, Δ=0.25 mm, $c_x$=4.15×10$^{-6}$, and $c_y$=9.6×10$^{-6}$. In FIG. 5*b*, (Gielis #13), $m_1$=4, $m_2$=0.5, $a_1$=$a_2$=1, $n_1$=5, $n_2$=8, $b_1$=3, Δ=0.25 mm, $c_x$=3.29×10$^{-5}$, and $c_y$=1.18×10$^{-5}$. In FIG. 5*c*, (Gielis #14), $m_1$=4, $m_2$=0.5, $a_1$=1, $n_1$=5, $n_2$=8, $b_1$=4, Δ=0.25 mm, $c_x$=8.85×10$^{-5}$, and $c_y$=3.8×10$^{-4}$.

The three waveguides include the same basic properties already shown in FIG. 1, only the contour of the slot is different. The slots of these waveguides have a general contour in common, that is hereby indicated as a 'bow-tie shape'. Further, the shown waveguides are single slot waveguides that include a top layer 7, pillars 11, and a slot 12

The bow-tie shape is based on a circumference of two lobes connected at a narrowed central section wherein the shape is oriented in the longitudinal direction of the waveguide.

Figure 6:
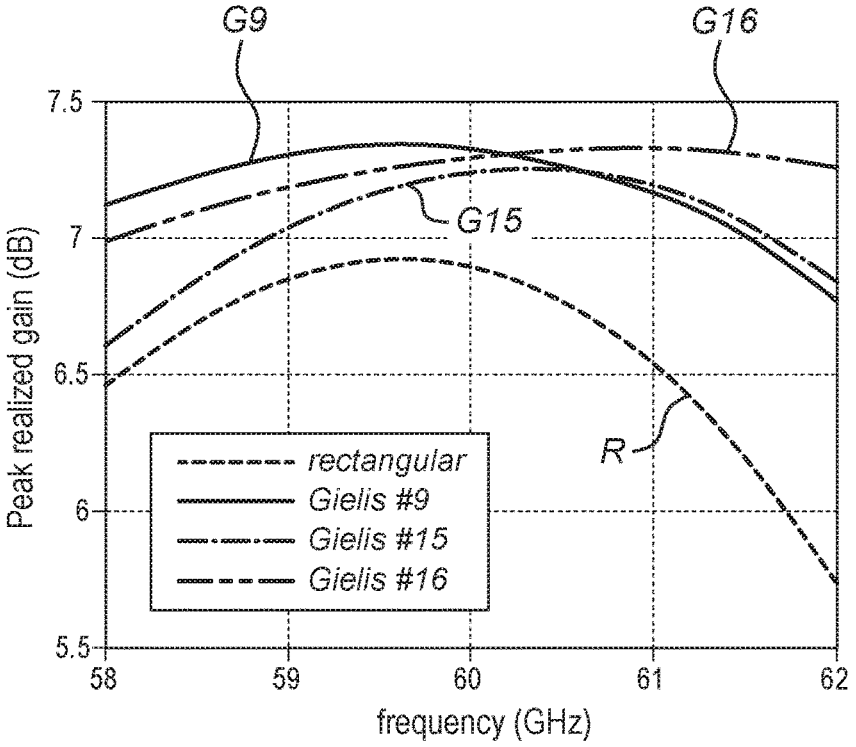
FIG. 6 shows test results for the first group of single slot waveguides.

FIG. 6 shows a graph of the measured peak realized gain in dB over the frequency range 58-62 GHz, when using the first group of single slot waveguides, which are coded as G9, G15, and G16 in accordance with the numbering in FIG. 4. The letter G indicates a contour compliant with the Gielis formula according to the invention. For comparison, a graph for a single slot waveguide from the prior art having a rectangular slot (which is indicated as R) is included as well. It can be appreciated, with respect to FIGS. 6, 7, 8*a*, 8*b* and 8*c*, that the horizontal axis corresponds to the frequency range and the vertical axis corresponds to the peak gain.

The graph clearly shows that all three variants of the first group of single slot waveguides according to the invention achieve a significantly enhanced peak gain value. Furthermore, this enhancement is achieved over the whole frequency range, and without substantial drops in peak gain of a magnitude observed for the prior art waveguide.

FIGS. 7 and 8*a*, 8*b*, and 8*c* show graphs of the measured peak realized gain in dB over the frequency range 58-62 GHz, when using several types of waveguides based on a linear array of slots, i.e. the secondary embodiment of the invention. All waveguides were based on an array of 8 slots, and were disposed on the top layer as shown in FIG. 2.

Figure 7:
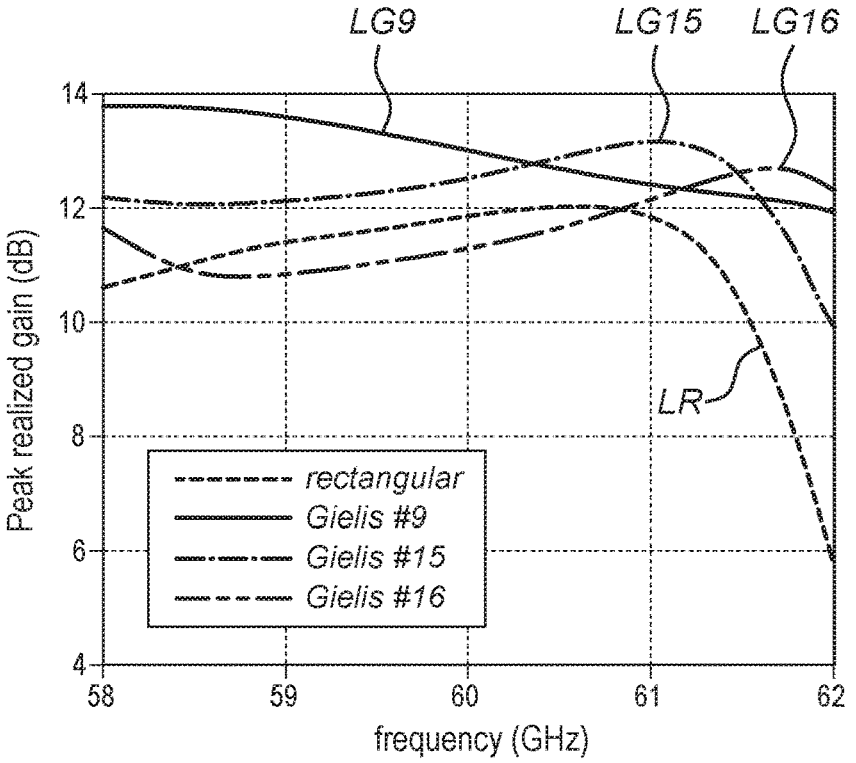
FIG. 7 shows a test result for a waveguide based on a linear array of the slot.

In FIG. 7, the results for three waveguides LG9, LG15 and LG16, are depicted in comparison to a prior art waveguide based on a linear array of rectangular slots (LR). Each waveguide according to the invention was provided with slots of a specific shape that corresponds to the numbering 9, 15, and 16, that is used and depicted in FIG. 4. The letter L indicates the waveguide structure is integrated with a linear array of slots.

Figure 8A:
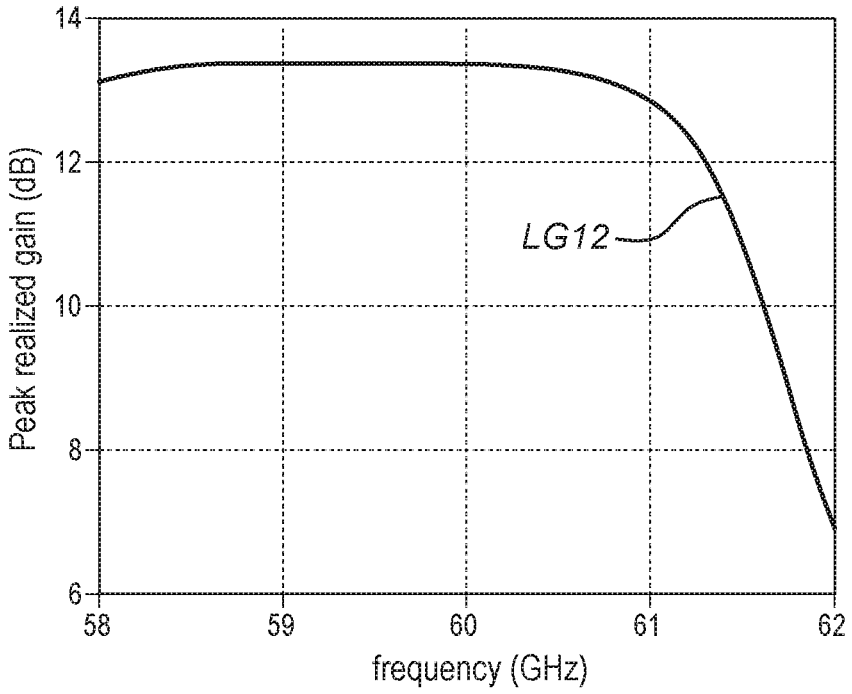
FIG. 8*a* shows a test result for a waveguide based on a linear array of the slot.
Figure 8B:
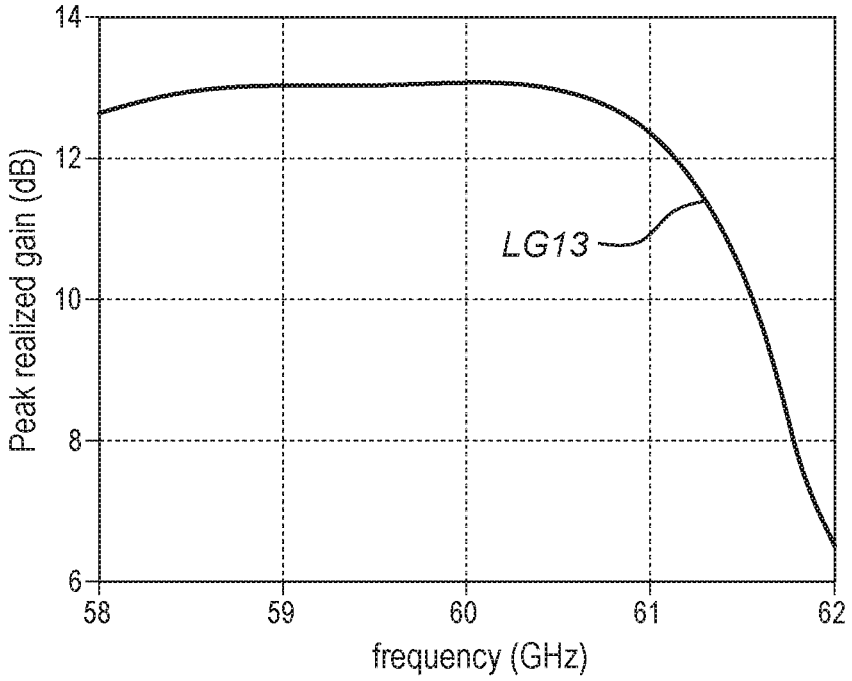
FIG. 8*b* shows a test result for a waveguide based on a linear array of the slot.
Figure 8C:
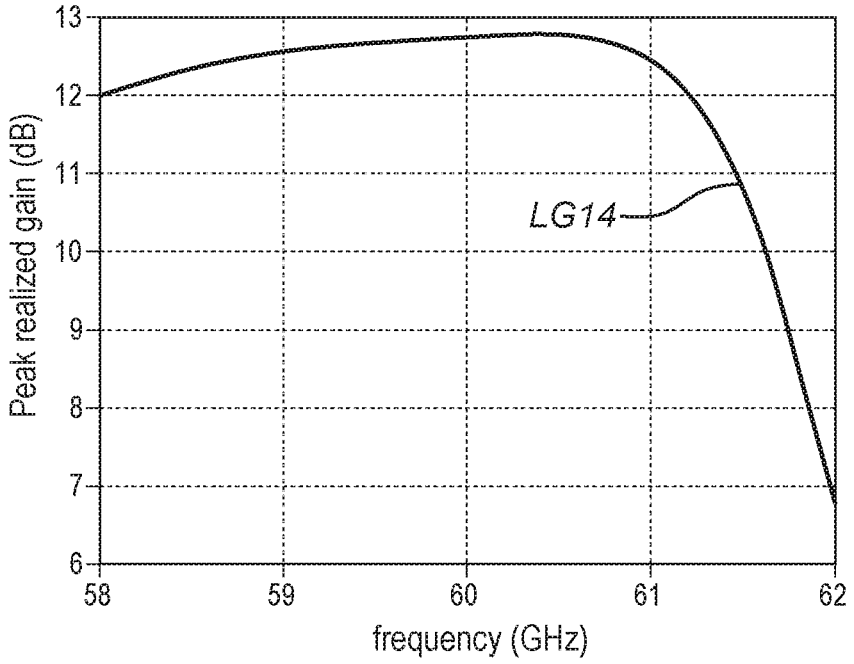
FIG. 8*c* shows a test result for a waveguide based on a linear array of the slot.

In FIGS. 8*a*, 8*b*, and 8*c*, respectively, the results for three waveguides LG12, LG13 and LG14, are depicted. Each of these waveguides was provided with slots of a specific shape that corresponds to the numbering 12, 13, and 14, that is used and depicted in FIG. 5.

In terms of results, FIG. 7 shows that LG9 and LG15 achieve a significantly enhanced peak gain value in dB. Furthermore, this enhancement is achieved over the whole frequency range, and without substantial drops in peak gain of a magnitude observed for the prior art waveguide. LG16 achieves a significantly enhanced peak gain value in the range 61-62 GHz, and has a peak gain comparable to LR in the range 58-61 GHz. LG16 has no substantial drops in peak gain of a magnitude observed for the prior art waveguide.

In terms of results, LG12 (FIG. 8*a*), LG13 (FIG. 8*b*) and LG14 (FIG. 8*c*), respectively, achieve a significantly enhanced peak gain value over LR (FIG. 7). Furthermore, this enhancement is achieved over the whole frequency range.

Figure 9:
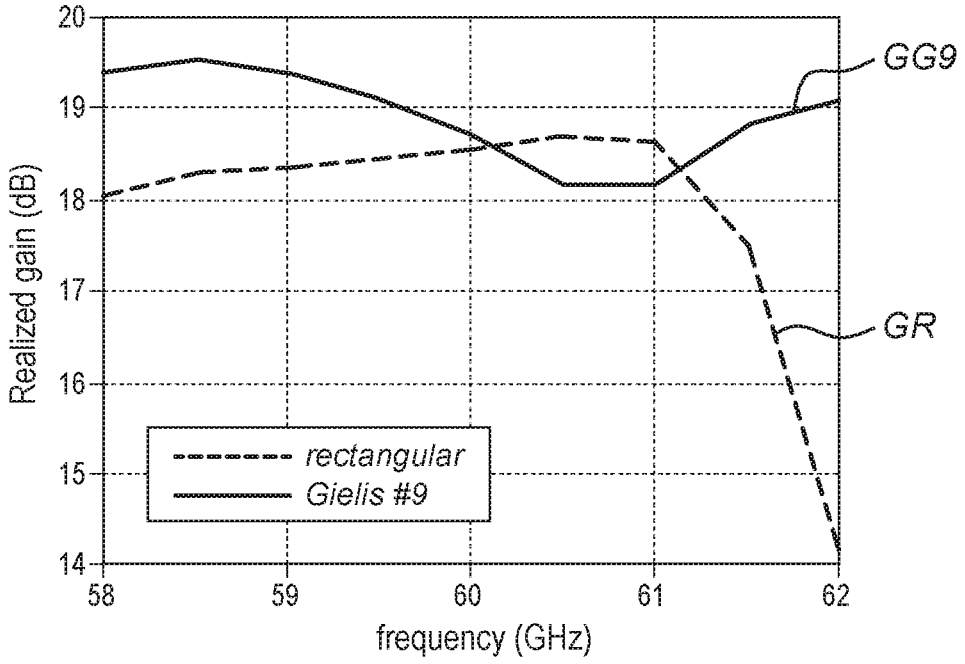
FIG. 9 shows test results for a waveguide based on a grid of slots.

FIG. 9 shows a graph of the measured peak realized gain over the frequency range 58-62 GHz, when using a waveguide based on a grid of slots, i.e. the tertiary embodiment of the invention.

This waveguide is based on 4 parallel disposed linear arrays, each array containing 8 slots, and disposed on the top layer in the manner shown in FIG. 3. Different from the configuration shown in FIG. 3, all slots have the same shape which corresponds to the one shown in FIG. 4*a*), which has the number code 9. Accordingly, the waveguide is coded GG9, wherein the first letter G indicates that the waveguide is integrated with a grid of slots according to the tertiary embodiment.

A comparison was made by performing the same measurements for an analogously configured grid of slots that in contrast was based on prior art rectangular slots. The graph for this prior art grid of slots is indicated as GR.

In terms of results, the tertiary embodiment of the waveguide which is exemplified by GG9, achieves an enhanced peak gain value in the ranges of 58-60 GHz and 61.2-62 GHz. Furthermore, GG9 has no substantial drops in peak gain of a magnitude observed for the prior art waveguide, this is most notable in the range of 61.2-62 GHz.

The invention claimed is:

1. A waveguide for electromagnetic radiation, which is a substrate integrated waveguide, comprising:

a substrate layer of dielectric material;

a bottom layer and a top layer each formed from an electrically conductive material provided on a respective bottom surface and top surface of the substrate layer;

a plurality of pillars of electrically conductive material which extend through the substrate layer from the bottom surface to the top surface and which are electrically connected to the bottom layer and top layer;

wherein at least one of the bottom layer and top layer contains at least one part that is void of said electrically conductive material, said at least one part is referred to as a slot;

wherein the at least one slot is delimited, in the plane of the respective layer in which the at least one slot is present, by a contour which is defined by an x and y coordinate which fulfils the following equations:

$$x(\phi)=c_x R(\phi)\cos(\phi)$$

$$y(\phi)=c_y R(\phi)\sin(\phi)$$

wherein:

$$R(\phi)=\left[\left|\frac{\cos\left(\frac{m_1\phi}{4}\right)}{a_1}\right|^{n_1}+\left|\frac{\sin\left(\frac{m_2\phi}{4}\right)}{a_2}\right|^{n_2}\right]^{\frac{1}{b_1}}$$

wherein the values for the parameters $c_x$, $c_y$, $m_1$, $m_2$, $a_1$, $a_2$, $n_1$, $n_2$ and $b_1$ are selected from a group of real numbers of positive value, and $\phi$ is an angular coordinate that covers a range from $-\pi$ to $\pi$;

wherein the contour is not of a rectangular shape, not of a rounded rectangular shape, and not of a cross-shape.

2. The waveguide according to claim 1, wherein at least one of the bottom layer and top layer contains a multitude of slots which include the at least one slot, wherein each individual slot is respectively delimited by the contour, such that the multitude of slots form a number of linear arrays of slots, wherein the number of linear arrays of slots are disposed adjacent to each other and in a parallel direction to each other, so that a grid of slots is formed, wherein the slots per linear array are disposed on a line extending parallel to a longitudinal direction of the waveguide, wherein the slots per linear array are spaced apart from each other by a distance in the longitudinal direction of the waveguide, wherein the plurality of pillars includes at least one row of pillars, and a row of pillars is provided between adjacent linear arrays of slots, wherein the substrate layer includes a plurality of circumferential sides and the row of pillars is disposed proximal to the circumferential sides of the substrate layer, wherein one circumferential side of the substrate layer is not provided with the row of pillars.

3. The waveguide according to claim 2, wherein the number of linear arrays of slots is 3 to 5.

4. The waveguide according to claim 1, wherein the contour of the at least one slot has a shape similar to a two-dimensional contour of either a hat or a bow-tie, and said shape is oriented in a longitudinal direction of the waveguide.

5. The waveguide according to claim 1, wherein the contour is defined by the following parameters:

$c_x$ is chosen from the range $6.0\times10^{-5}$ to $8.0\times10^{-5}$, $c_y$ is chosen from the range $7.4\times10^{-4}$ to $9.6\times10^{-4}$, $m_1=2.8$, $m_2=3.2$, $a_1=a_2=1$, $n_1=n_2=5$ and $b_1=2$.

6. The waveguide according to claim 1, wherein the contour is defined by the following parameters:

$c_x$ is chosen from the range $4.0\times10^{-6}$ to $9.0\times10^{-5}$, $c_y$ is chosen from the range $1.25\times10^{-6}$ to $3.8\times10^{-5}$, $m_1=4$, $m_2=0.5$, $a_1=a_2 2=1$, $n_1=5$, $n_2=8$, and $b_1$ is chosen from the range of 2 up to 4.

7. The waveguide according to claim 1, wherein at least one of the bottom layer and top layer contains a multitude of slots which include the at least one slot, wherein each individual slot respectively is delimited by the contour, such that the multitude of slots form at least one linear array of slots, wherein said linear array of slots is disposed on a line extending in a longitudinal direction of the waveguide, and wherein adjacent slots of the said linear array of slots are spaced apart from each other by a distance in the longitudinal direction of the waveguide.

8. The waveguide according to claim 7, wherein respective central points of the individual slots of the at least one linear array of slots are positioned at a pre-determined offset distance from the longitudinal axis of the waveguide, and wherein respective central points of adjacent slots of the said linear array of slots are positioned on different sides of the longitudinal axis projected on the respective layer.

9. The waveguide according to claim 7, wherein the distance between respective central points of adjacent slots in the longitudinal direction of the waveguide is half of the guided wavelength of a signal that is applied to the waveguide.

10. The waveguide according to claim 7, wherein the number of slots contained in the at least one linear array of slots is 6 to 10.

11. The waveguide according to claim 7, which has a length that corresponds to a guided wavelength of a signal that is applied to the waveguide, and which is multiplied by a factor of 3 to 5.

12. The waveguide according to claim 1, wherein the contour of the at least one slot has a slot length which lies in the range of 1.8 to 2.7 mm.

13. The waveguide according to claim 1, wherein the contour of the at least one slot has a slot width which lies in the range of 0.24 to 0.32 mm.

14. The waveguide according to claim 1, wherein the substrate layer, the bottom layer and the top layer each have a rectangular circumference in a plane of the respective layer.

15. The waveguide according to claim 1, wherein the waveguide is effective for electromagnetic radiation in the frequency range from 58 to 62 GHz.

16. The waveguide according to claim 1, wherein the at least one the slot has a respective central point that is positioned at an offset distance ($\Delta$) from a longitudinal axis of the waveguide which lies in the range of 0.20 to 0.30 mm.

* * * * *